US005150794A

United States Patent [19]

Rooks

[11] Patent Number: 5,150,794

[45] Date of Patent: Sep. 29, 1992

[54] YARN CABINET

[76] Inventor: George E. Rooks, P.O. Box 368, Penrose, Colo. 81240-0368

[21] Appl. No.: 756,781

[22] Filed: Sep. 9, 1991

[51] Int. Cl.[5] ..... B65D 85/67; B65H 75/06

[52] U.S. Cl. ..... 206/574; 206/388; 220/507; 220/554; 220/524

[58] Field of Search ..... 206/336, 338, 348, 388, 206/49, 486, 380, 382, 574; 220/23.2, 23.8, 23.83, 23.86, 507, 554, 524; 217/7, 18, 25, 25.5

[56] References Cited

U.S. PATENT DOCUMENTS

| | | | |
|---|---|---|---|
| 2,017,176 | 10/1935 | Andrews | 206/388 X |
| 2,020,663 | 11/1935 | Stapleford | 206/388 |
| 2,928,534 | 3/1960 | Chiu | 206/382 X |
| 3,189,074 | 6/1965 | Schaefer | 220/507 X |
| 4,008,806 | 2/1977 | de Paez et al. | 206/388 X |
| 4,548,055 | 10/1985 | Macdonald | 206/388 X |
| 4,890,741 | 1/1990 | Edelstein | 220/23.83 X |
| 4,923,058 | 5/1990 | Dennison | 206/83 |

FOREIGN PATENT DOCUMENTS

| | | | |
|---|---|---|---|
| 490902 | 6/1955 | Italy | 206/574 |

*Primary Examiner*—Paul T. Sewell
*Assistant Examiner*—Jacob K. Ackun, Jr.
*Attorney, Agent, or Firm*—Richard C. Litman

[57] ABSTRACT

A yarn/needlecraft accessory storage device is provided. The storage device has a hinged lid which when opened allows access to the interior. The interior section has vertically oriented cavities designed to hold yarn. Each of these cavities has a lid with a small hole in it. A small portion of yarn is placed in this small hole to indicate the color of the yarn stored therein. Also, the yarn may be pulled through the small holes to permit knitting. The storage device is designed to be of lightweight construction and portable. A cushion is attached atop the hinged lid to allow the yarn cabinet to function as a stool.

11 Claims, 2 Drawing Sheets

YARN CABINET

FIELD OF THE INVENTION

The present invention relates to a cabinet for storage of needlecraft supplies. More specifically this invention relates to a cabinet for storing yarn, needles and associated items and devices.

DESCRIPTION OF THE PRIOR ART

A variety of storage devices are known in the art. U.S. Pat. No. 4,067,607 issued to Battles discloses a combination stool and fishing tackle box. This invention shows a stool which is cylindrical in design and primarily hollow. Access to the interior is through the side of the device, where horizontal dividers compartmentalize the interior of the stool. The device is specifically disclosed to store fishing tackle.

U.S. Pat. No. 4,630,730 issued to Storey discloses a knitting project workbox. This device is square in design and has a handle for portability. It is designed with the intent of storing individual yarns in a rectangular array, with one color yarn per individual subsection. A lid with a hole enables the user to access the yarn from the storage subsection.

U.S. Pat. No. 2,537,940 issued to Peake discloses circular sewing kit for retaining spools of thread. The kit is cylindrical and hollow and has a lid. Inside the circular box, the spools of thread are held against the interior wall in a radial fashion. The spools are held there by a plurality of spool holders which constrain the spools to their position. By small holes in the receptacle, thread may be accessed.

Other storage devices are known, such as U.S. Pat. No. 4,111,342 issued to Carrozo, U.S. Pat. No. 4,846,351 issued to Gardiner and U.S. Pat. No. 3,322,310 issued to Higgs. These all show storage devices for needlecraft items.

None of the above referenced devices, considered either singly or in combination, is seen to suggest the instant invention as claimed.

SUMMARY OF THE INVENTION

The invention consists of a needlecraft and yarn storage cabinet. A partition member divides the cabinet into upper and lower chambers. The lower chamber has a number of cylindrical cavities designed to hold shanks of yarn. The partition member has a number of openings equal to the number of cylindrical cavities. The yarn storage cabinet has a hinged lid which also acts as the top of the cabinet itself. Lifting the lid up allows access to the storage area where yarn and various needlecraft items are kept. The yarn is stored vertically in cylindrical cavities. Needlecraft items such as hooks and needles are stored on the interior of the top cabinet lid where holding devices are attached. A second panel is provided in the upper chamber as well. The second panel is pivotally connected with the top cabinet lid. The second panel is provided with holding devices on both the top and bottom for holding assorted needlecraft items.

Accordingly, one object of the present invention is to provide a needlecraft supply storage area.

Another object of the invention is to provide a means for storing yarn and knitting devices in an organized manner.

Yet another object of the invention is to provide a light-weight yet sturdy device which would be easy to move to any desired location.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
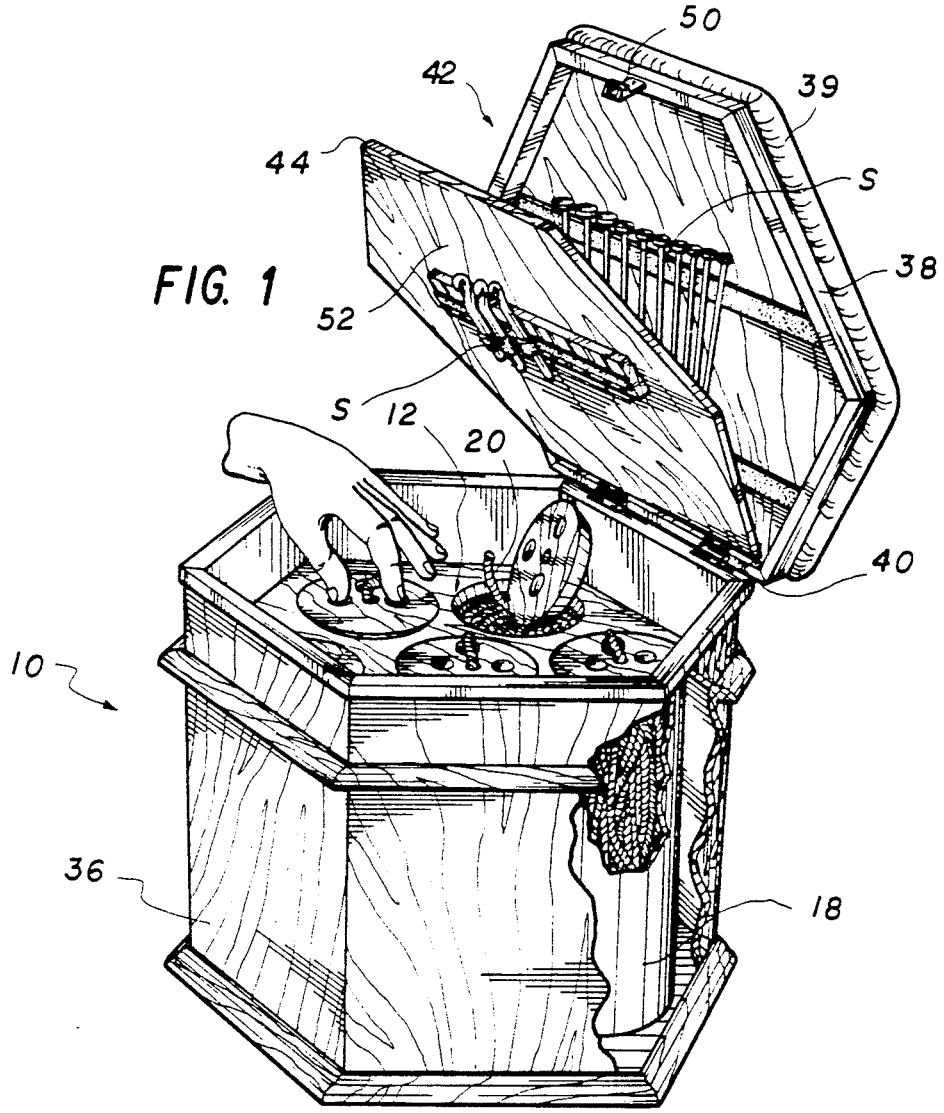
FIG. 1 is a front perspective view of the preferred embodiment.

The present invention is a storage cabinet 10 for needlecraft supplies and yarn. The cabinet 10 has a partition member 12 placed inside which defines an upper 14 and a lower chamber 16. The lower chamber 16 has a plurality of cylindrical cavities 18 located within, these cavities 18 are designed to hold hanks of yarn 20. The partition member 12 has a plurality of openings 22 equal to the number of cavities 18, and these openings 22 are coincident to the top of the cylindrical cavities. The cylindrical cavities 18 are tube like and are appropriately secured to the bottom of the lower chamber 16 by adhesive or mechanical attachment.

Covers 24 are provided for the openings 22. The cover 24 fits snugly over the opening 22 in a wedge 26 type manner. A hole 28 is provided through the middle of the cover 24. An end piece 30 from the roll of yarn 20 is placed through this hole 28, allowing an observer to ascertain what color yarn is enclosed by the covered cavity 18. Also yarn can be pulled through a plurality of holes 28 to allow actual knitting to occur. The covers 24 are provided with two depressions 32 to allow easy removal as well as a yarn end-piece holding device 34 in this case a velcro tab.

Figure 2:
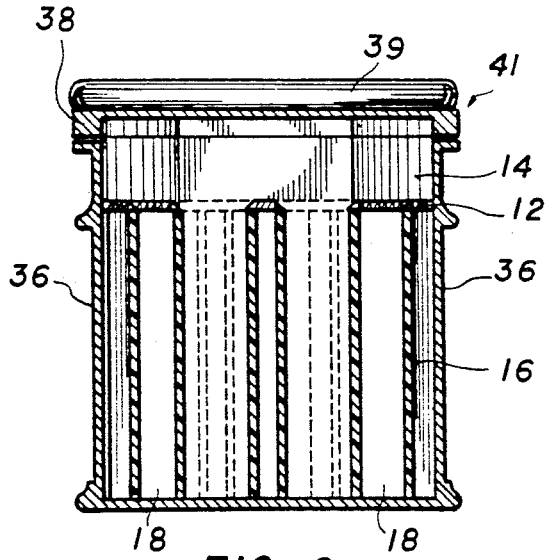
FIG. 2 is a cross-sectional view disclosing the internal structure.
Figure 3:
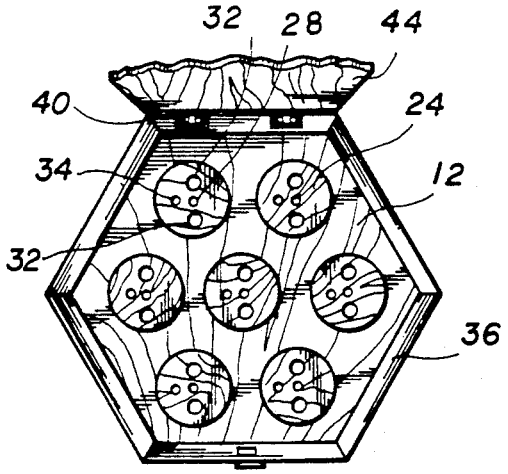
FIG. 3 is a top plan view of the preferred embodiment.
Figure 4:
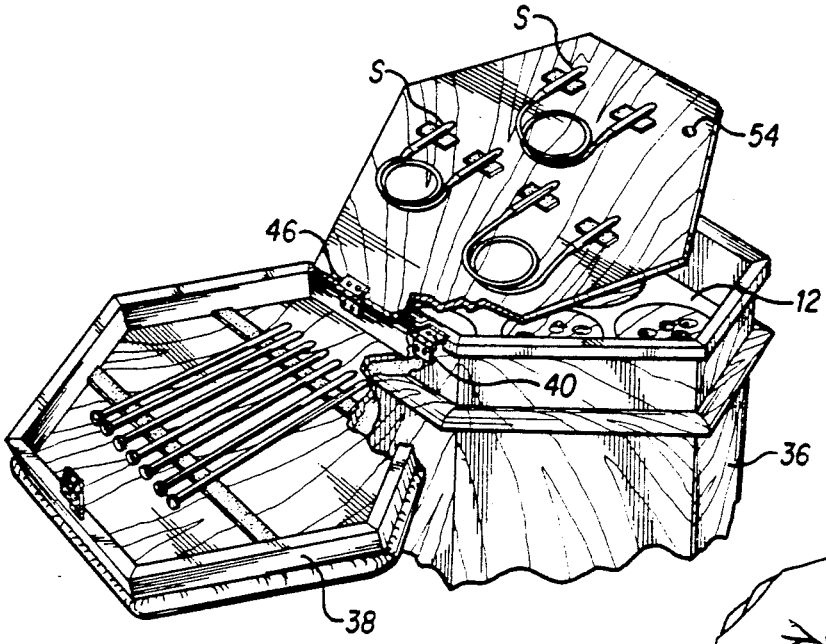
FIG. 4 is a cut away view of the top of the preferred embodiment showing the hinged top and the inner lid.
Figure 5:
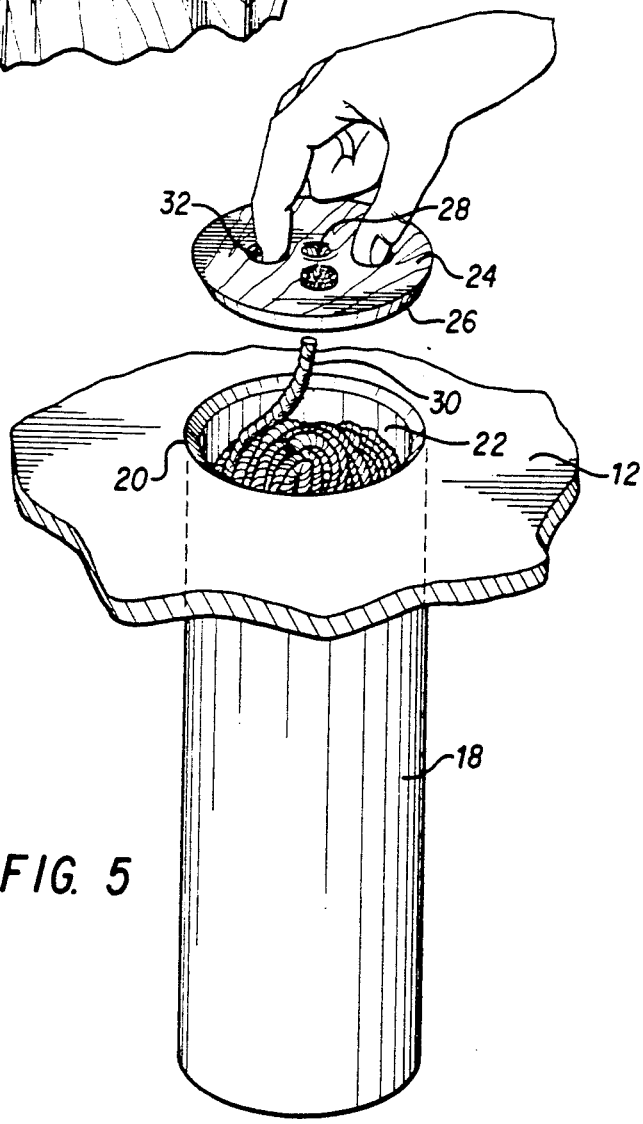
FIG. 5 is a cut away view showing an individual storage tube.

The cabinet 10 has sidewalls 36 which surround the upper 14 and lower chambers 16, the partition member 12 and the cavities 18. The cabinet 10 has a top opening and a top member 38 which acts as the top of the cabinet. The top member 38 is pivotally attached by hinges 40 to the sidewall 36. In this manner the top member 38 is able to rotate from a closed position (41, FIG. 2) flush with the sidewalls 36 to a generally open position (42, FIG. 1) which allows access to the interior. A latch 50 is provided on the top member 38 to secure the top member 38 to a sidewall 36. The exterior of top member 38 has a cushion 39 attached to allow the yarn cabinet 10 to act as a stool for sitting. The sidewalls 36 can be arranged in variety of geometrical configurations; a hexagonal embodiment is shown in the drawings.

A panel 44 is provided intermediate partition member 12 and top member 38 in the upper chamber 14 which is pivotally attached by hinges 46 to the interior of the top member 38. This panel 44 is flat and has storage devices S attached to both the top face 54 of the panel 44 and the bottom face 52 of the panel 44. These storage devices S are designed to hold various needlecraft items such as knitting needles. These storage devices S can be of various types, including mechanical holders and adhesive tapes. This panel 44 is also designed to rotate to allow the user to get to both the top 54 and bottom face 52 of the panel 44. The interior of the top member 38 is also provided with a storage device S.

It is to be understood that the present invention is not limited to the sole embodiment described above, but encompasses any and all embodiments within the scope of the following claims.

I claim:

1. A yarn storage device comprising:

a cabinet having a partition member disposed therein and defining a lower chamber therebeneath, said lower chamber including a plurality of cylindrical cavities therein to maintain hanks of yarn, said partition member having a plurality of openings respectively communicating with each said cavity, a plurality of lids for enclosing said openings, said lids provided with a hole therethrough to receive the distal portion of a hank of yarn, said lids provided with means for retaining said distal portion of a hank of yarn atop each said lid, whereby one can gauge what color yarn is contained within each said cavity by observing said distal portion atop said lids.

2. A yarn storage device as claimed in claim 1 further comprising a sidewall, said sidewall having a top opening, said top opening having a top member pivotally attached to said sidewall, whereby said top member can rotate about said sidewall causing said storage device to be in an open or closed position.

3. A yarn storage device as claimed in claim 2 wherein said lids include a plurality of depressions which enable removal of said lids from said cavities.

4. A yarn storage device as claimed in claim 3 wherein said top member has an exterior and an interior.

5. A yarn storage device as claimed in claim 4 including a panel, said panel having a top face and a bottom face, said panel pivotally attached to said interior of said top member.

6. A yarn storage device as claimed in claim 5 including a first storage means attached to said top face of said panel.

7. A yarn storage device as claimed in claim 6 including a second storage means attached to said bottom face of said panel.

8. A yarn storage device as claimed in claim 7 including securing means, said securing means attached to said top member whereby said top member may be secured to said sidewall.

9. A yarn storage device as claimed in claim 8 wherein said securing means comprises a latch.

10. A yarn storage device as claimed in claim 9 including a third storage means attached to said interior of said top member.

11. A yarn storage device as claimed in claim 10 further comprising a cushion, said cushion attached atop said exterior of said top member.

* * * * *